US009534791B2

(12) United States Patent
Wie et al.

(10) Patent No.: US 9,534,791 B2
(45) Date of Patent: Jan. 3, 2017

(54) COOKING APPLIANCE

(71) Applicant: LG ELECTRONICS INC., Seoul (KR)

(72) Inventors: Jeahyuk Wie, Seoul (KR); Ingyu Yang, Seoul (KR); Youngsoo Kim, Seoul (KR); Yangho Kim, Seoul (KR)

(73) Assignee: LG ELECTRONICS, INC., Seoul (KR)

( * ) Notice: Subject to any disclaimer, the term of this patent is extended or adjusted under 35 U.S.C. 154(b) by 323 days.

(21) Appl. No.: 14/338,817

(22) Filed: Jul. 23, 2014

(65) Prior Publication Data

US 2015/0285510 A1 Oct. 8, 2015

(30) Foreign Application Priority Data

Apr. 3, 2014 (KR) ..... 10-2014-0039837

(51) Int. Cl.

| | |
|---|---|
| ***F24C 3/02*** | (2006.01) |
| ***F24C 5/12*** | (2006.01) |
| ***F24C 3/08*** | (2006.01) |
| ***F24C 15/32*** | (2006.01) |

(52) U.S. Cl.

CPC ..... *F24C 3/025* (2013.01); *F24C 3/087* (2013.01); *F24C 5/12* (2013.01); *F24C 15/322* (2013.01)

(58) Field of Classification Search

CPC ..... F24C 5/12
USPC ..... 126/273 R, 21 A
See application file for complete search history.

(56) References Cited

U.S. PATENT DOCUMENTS

| | | | | | |
|---|---|---|---|---|---|
| 3,698,377 | A | * | 10/1972 | Smith | F24C 15/322 126/21 A |
| 4,498,453 | A | | 2/1985 | Ueda | |
| 4,648,377 | A | * | 3/1987 | Van Camp | F24C 15/322 126/21 A |
| 4,867,132 | A | | 9/1989 | Yencha | |
| 4,909,236 | A | | 3/1990 | Del Fabbro | |
| 5,568,803 | A | | 10/1996 | Brown | |

FOREIGN PATENT DOCUMENTS

| | | | |
|---|---|---|---|
| GB | 201382 | A | 8/1923 |
| JP | 2535003 | B2 | 9/1996 |
| KR | 10-2012-0120535 | A | 11/2012 |
| WO | 03-040626 | A1 | 5/2003 |

* cited by examiner

*Primary Examiner* — Avinash Savani
(74) *Attorney, Agent, or Firm* — Dentons US LLP

(57) ABSTRACT

A cooking appliance includes a cavity to provide a cooking chamber, a door to open and close the cooking chamber, a partition plate to partition the cavity into a first chamber and a second chamber, the partition plate facing the door in the closed state, and a burner assembly disposed in the second chamber to supply heated air into the first chamber.

24 Claims, 18 Drawing Sheets

COOKING APPLIANCE

CROSS-REFERENCE TO RELATED APPLICATIONS

The present application claims priority under 35 U.S.C. 119 and 35 U.S.C. 365 to Korean Patent Application No. 10-2014-0039837 (filed on Apr. 3, 2014), which is hereby incorporated by reference in its entirety.

BACKGROUND

The present disclosure relates to a cooking appliance.

Cooking appliances are devices for cooking foods by using heat of a heating source. Cooking appliances, for example, an oven range includes an oven chamber in which foods are cooked and a burner that produces combustion of gas to cook the foods within the oven chamber.

SUMMARY

Embodiments provide a cooking appliance.

In one embodiment, a cooking appliance includes: a cavity to provide a cooking chamber; a door to open and close the cooking chamber; a partition plate to partition the cavity into a first chamber and a second chamber, the partition plate facing the door in the closed state; and a burner assembly disposed in the second chamber to supply heated air into the first chamber.

In another embodiment, a cooking appliance includes: a cavity to provide a cooking chamber; a door to open and close the cooking chamber; a partition plate to partition the cooking chamber into a first chamber and a second chamber and faces the door in the closed state; and a burner disposed in the second chamber, the burner including a supply part to receive gas and air; and a nozzle holder disposed outside a rear wall of the cavity, the nozzle holder including a gas spraying hole to spray the gas into the supply part passing through the rear wall of the cavity and a guide to align the supply part with the gas outlet hole.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present application. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
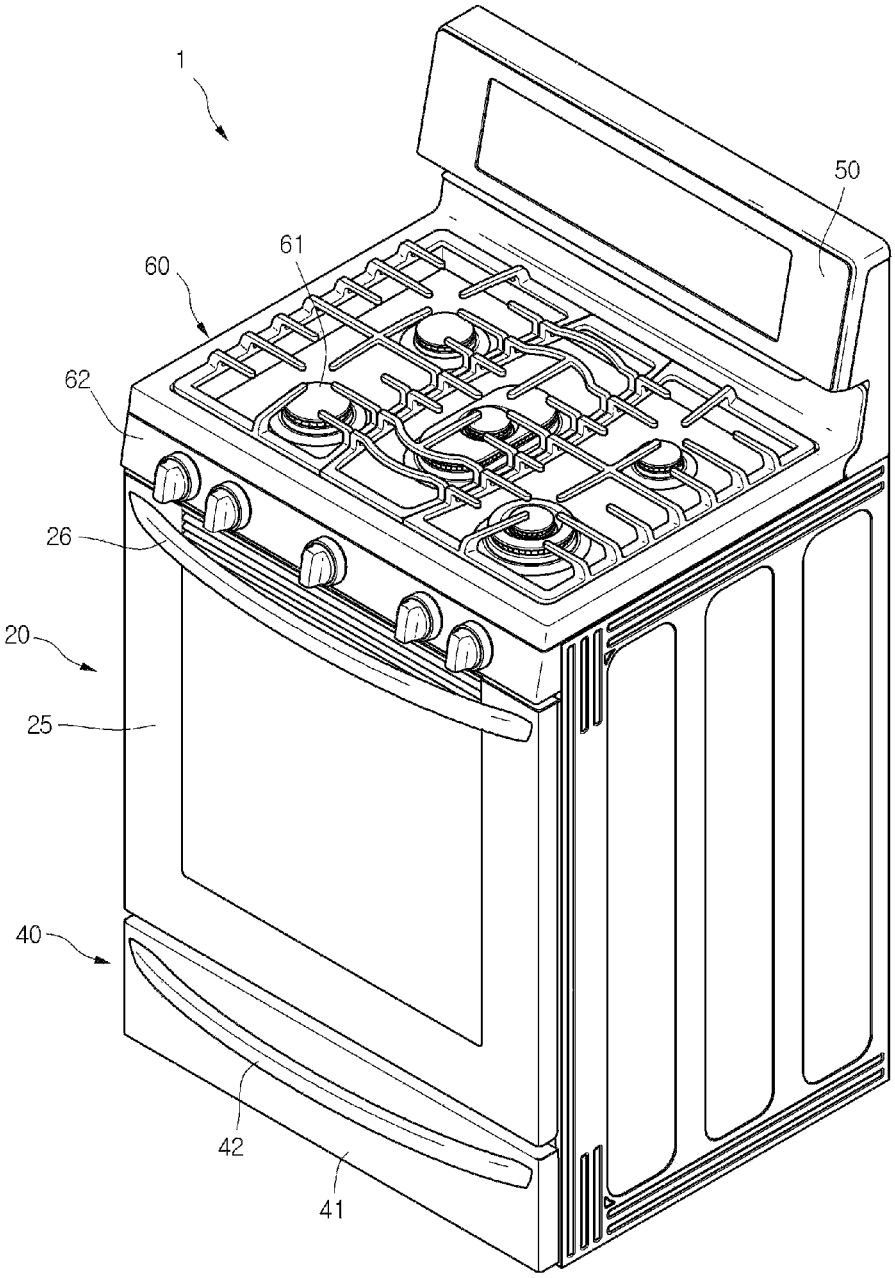
FIG. 1 is a perspective view of a cooking appliance according to a first embodiment.
Figure 2:
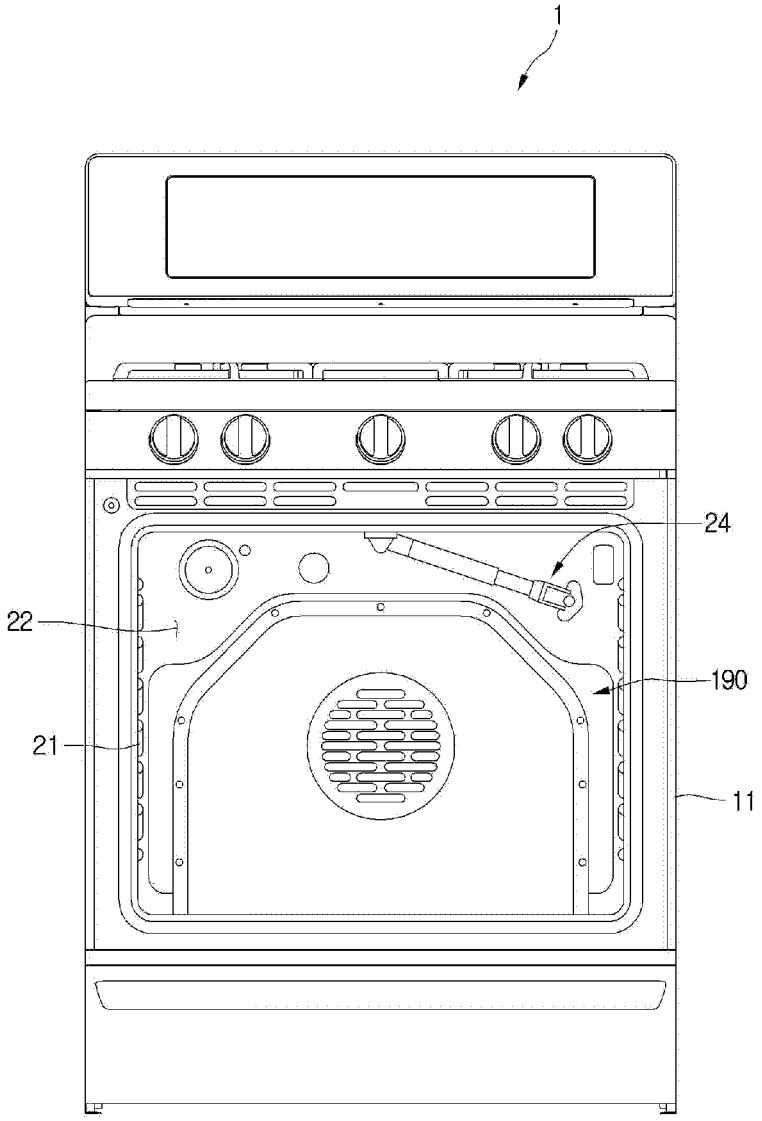
FIG. 2 is a front view of a state in which a door is removed from the cooking appliance according to the first embodiment.

FIG. 1 is a perspective view of a cooking appliance according to a first embodiment, and FIG. 2 is a front view of a state in which a door is removed from the cooking appliance according to the first embodiment.

Referring to FIGS. 1 and 2, a cooking appliance 1 according to a first embodiment includes an oven unit 20, a cook-top unit 60, a drawer unit 40, and a control unit 50. Also, the cooking appliance 1 includes an outer case 11. The outer case 11 may cover both side surfaces and rear surfaces of the oven unit 20 and the drawer unit 40.

However, according to a kind of cooking appliance 1, the cook-top unit 60 and the drawer unit 40 may be omitted.

The cook-top unit 60, the oven unit 20, and the drawer unit 40 may be disposed on an upper portion, a central portion, and a lower portion of the cooking appliance 1, respectively. Also, the control unit 50 is disposed on a rear end of a top surface of the cooking appliance 1.

The cook-top unit 60 may include a plurality of cook-top burners 61. The cook-top burner 61 may heat a container in which a food is contained or directly heat a food by using flame that is generated by burning gas. A manipulation unit 62 for manipulating the plurality of cook-top burners 61 is disposed on a front end of the cook-top unit 60.

For another example, the cook-top unit 60 may include at least one electric heater. However, the at least one electric heater may not be exposed to the outside of the cook-top unit 60. Thus, the current embodiment is not limited to a kind of heating source constituting the cook-top unit 60.

The oven unit 20 includes a cavity 21 that provides a cooking chamber 22 in which the food is cooked. The cavity 21 may have a rectangular parallelepiped shape having an opened front surface, but the present disclosure is not limited thereto.

The oven unit 20 may include an upper burner 24 for cooking the food accommodated in the cooking chamber 22. Also, the oven unit 20 may include a partition plate 190 for partitioning the cooking chamber 22 into a first chamber (see reference numeral 22*a* of FIG. 14) and a second chamber (see reference numeral 22*b* of FIG. 14). The partition plate 190 may be coupled to a rear wall 35 of the cavity 21 in the cooking chamber 22.

Figure 14:
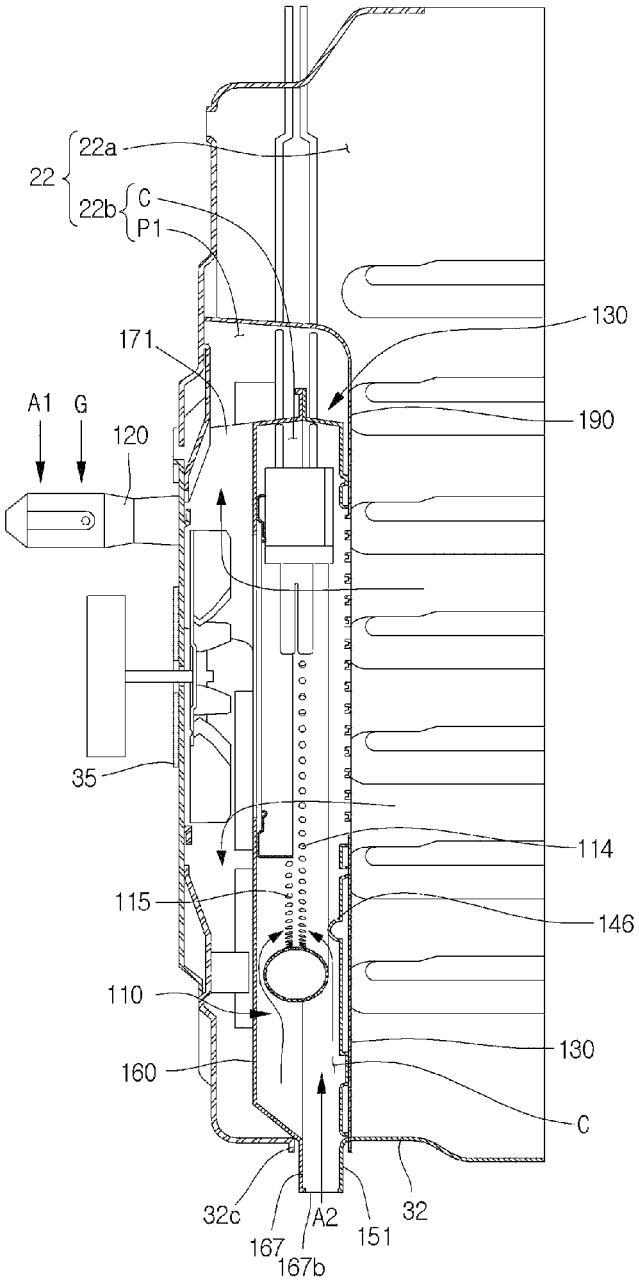
FIG. 14 is a vertical cross-sectional view of a state in which the burner assembly is installed in a cavity according to the first embodiment.

The oven unit 20 may further include a burner assembly (see reference numeral 23 of FIG. 4) disposed in the second chamber (see reference numeral 22*b* of FIG. 14). Also, the food may be accommodated in the first chamber (see reference numeral 22*a* of FIG. 14).

The burner assembly (see reference numeral 23 of FIG. 4) and the upper burner 24 may operate at the same time. Alternatively, only one of the burner assembly (see reference numeral 23 of FIG. 4) and the upper burner 24 may operate.

The upper burner 24 may provide heat to the food from an upper side of the food within the cooking chamber 22, and the burner assembly (see reference numeral 23 of FIG. 4) may be disposed at a rear side of the food within the cooking chamber 22.

The oven unit 20 may further include a door 25 for opening/closing the cooking chamber 22. The door 25 may be rotatably connected to the cooking appliance 1. For example, the door 25 may open/close the cooking chamber 22 in a pull-down method in which a lower end of the door 25 rotates about an axis with respect to a lower end of the cooking chamber 22. The current embodiment is not limited to the operation method of the door 25.

A door handle 26 that is grasped by a user so as to rotate the door 25 may be disposed on an upper end of a front surface of the door 25.

The drawer unit 40 may keep the container, in which the food is contained, at a predetermined temperature. A drawer 41 in which the container is accommodated may be provided in the drawer unit 40. The drawer 41 may be inserted into or withdrawn from the cooking appliance 1 in a sliding manner. A handle 42 to be grasped by the user may be disposed on a front surface of the drawer 41.

The control unit 50 may receive a manipulation signal for operating the cooking appliance 1, particularly, a manipulation signal for operating at least one of the cook-top unit 60, the oven unit 20, and the drawer unit 40. Also, the control unit 50 may display various information with respect to the operation of the cooking appliance 1 to the outside.

Figure 3:
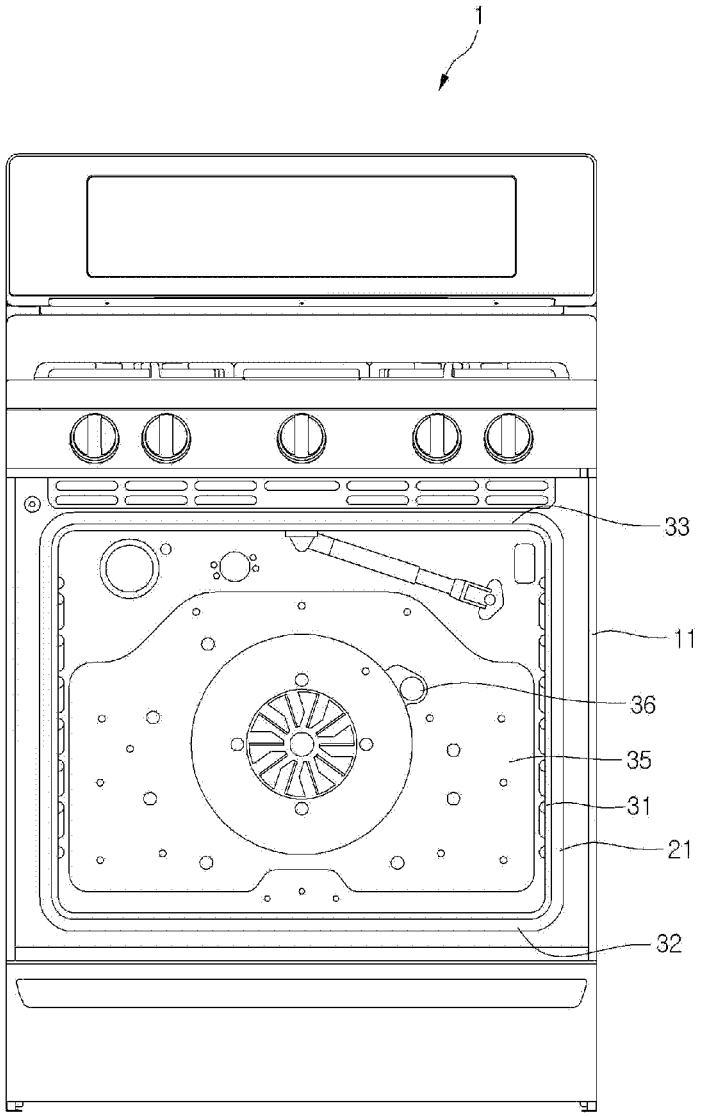
FIG. 3 is a view of a state in which a burner assembly is removed in FIG. 2.
Figure 4:
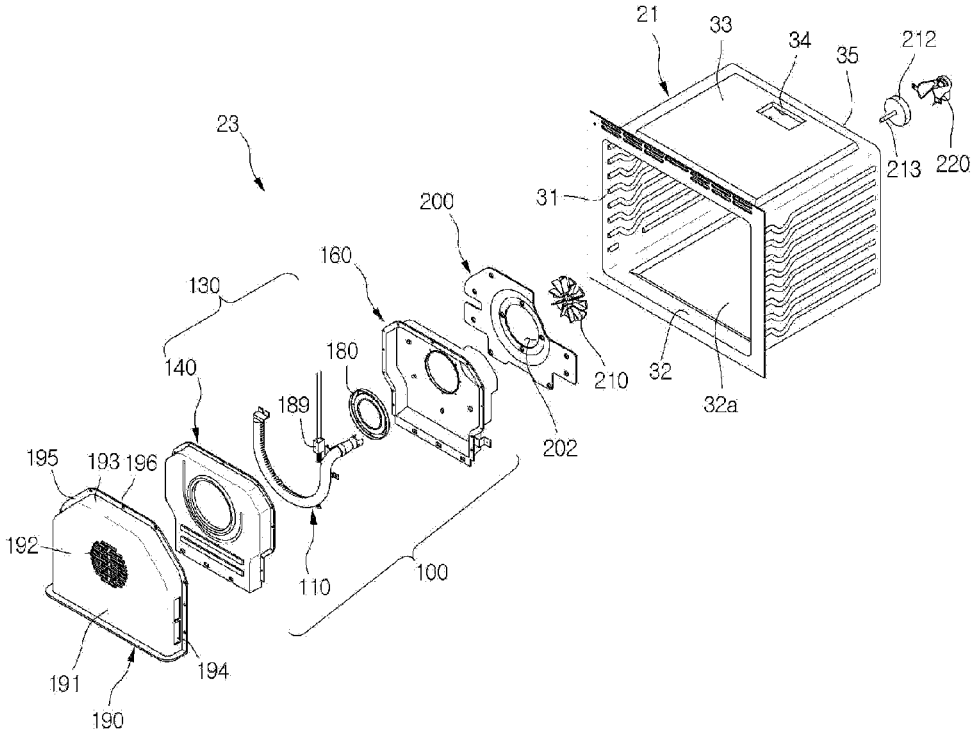
FIG. 4 is an exploded perspective view of the burner assembly according to the first embodiment.

FIG. 3 is a view of a state in which a burner assembly is removed in FIG. 2, and FIG. 4 is an exploded perspective view of the burner assembly according to the first embodiment.

Referring to FIGS. 2 to 4, the cavity 21 may include both sidewalls 31, a bottom wall 32, an upper wall 33, and a rear wall 35.

In the current embodiment, the "front side" may represent a direction that is directed to a front surface of the cooking appliance 1, and the "rear side" may represent a direction that is directed to a rear surface of the cooking appliance 1.

Also, the "front side" within the cooking chamber 22 may represent a direction that is directed towards the door 25 of the oven unit 20, when closed, and the "rear side" may represent a direction that is directed towards the rear wall 35 of the cavity 21.

The partition plate 190 may be coupled to the rear wall 35 of the cavity 21. That is, in the current embodiment, the partition plate 190 may be disposed on the rear wall 35 of the cavity 21, and the burner assembly (see reference numeral 23) may be disposed in the second chamber (see reference numeral 22*b* of FIG. 14) between the partition plate 190 and the rear wall 35 of the cavity 21. Thus, since a recessed part 32*a* that is recessed downward from the bottom wall 32 of the cavity 21 is defined, the cavity 21 may increase in volume by the amount of the recessed part 32*a*. Generally, in a conventional cooking appliance, a conventional burner is disposed at the bottom wall 32 in the recessed part 32*a* occupying the volume of the recessed part 32*a*. This also causes difficulty in cleaning the recess parts 32*a*. Further, in the present embodiment, because the burner assembly is not disposed in the recessed part 32*a*, there are no coupling holes found at the recessed part 32*a*, which can potentially seep, food leftovers unto the floor, for example, if the coupling members are not properly coupled.

The burner assembly 23 may include a burner device 100, a fan 210, and a fan motor 212.

The burner device 100 may include a burner 110 for burning gas to generate flame and a burner cover 130 covering the burner 110.

A burner hole 36 through which the burner 110 passes may be defined on the rear wall 35 of the cavity 21. That is, the burner 110 may be disposed in the cooking chamber 22, and a portion of the burner 110 may pass through the burner hole 36 and be disposed between the rear wall 35 of the cavity 21 and the outer case 11.

An exhaust hole 34 through which an exhaust gas is discharged may be defined on the upper wall 33 of the cavity 21. Alternatively, the exhaust hole 34 may not be defined on the upper wall 33, but be defined on the rear wall 35 of the cavity 21.

The burner cover 130 may include a first cover 140 and a second cover 160. For example, the first cover 140 covers the burner 110 at a front side of the burner 110, and the second cover 140 covers the burner 110 at a rear side of the burner 110.

The burner device 100 may further include an igniter 189 for igniting a mixture gas supplied into the burner 110 and a stabilizer 180 for stabilizing flame.

For example, the igniter 189 may be disposed on the burner 110, and the stabilizer 180 may be disposed on the second cover 160. A portion of the igniter 189 may pass through the second cover 160 and the upper wall 33 of the cavity 21. In another example, the igniter 189 may be disposed on the first cover 140 or the second cover 160.

The burner device 100 will be described below with reference to the accompanying drawings.

The fan 210 allows heated air to flow into the cooking chamber 22. The fan motor 212 is disposed between the rear wall 35 of the cavity 21 and the outer case 11, and the fan 210 is disposed in the second chamber (see reference numeral 22*b* of FIG. 14) within the cooking chamber 22. Thus, a shaft 213 of the fan motor 212 may pass through the rear wall 35 of the cavity 21 and be coupled to the fan 210. The fan motor 212 may be fixed to the rear wall 35 of the cavity 21 or the outer case 11 by a motor mount (not shown).

The partition plate 190 protects the burner device 100. Also, the partition plate 190 may prevent food leftovers from contaminating the burner device 100 when the food is cooked.

The partition plate 190 may include a front plate 191, an extension part 193 extending from the front plate 191 toward the rear wall 35 of the cavity 21, and a contact part 195 bent from the extension part 193.

An air suction hole 192 through which air within the cooking chamber 22 is suctioned is defined on the front plate 191, and an air discharge hole 194 through which air heated by the burner device 100 is discharged into the cooking chamber 22 is defined on the extension part 193. In another example, the air discharge hole 194 may be defined on the front plate 191 or defined on each of the front plate 191 and the extension part 193.

The contact part 195 may contact the rear wall 35 of the cavity 21 in a state where the contact part 195 covers the burner device 100. A coupling hole 196 to which a coupling member (not shown) is coupled is defined on the contact part 195.

A lower end of the partition plate 190 may contact the bottom wall 32 of the cavity 21 in a state where the partition plate 190 is coupled to the rear wall 35 of the cavity 21 by the coupling member. That is, the front plate 191 and lower ends of the extension part 193 and the contact part 195 may contact the bottom wall 32 of the cavity 21. Alternatively, the front plate 191 and the extension part 193 may contact the bottom wall 32 of the cavity 21.

Here, the partition plate 190 may contact the bottom wall 32 of the cavity 21 between the recessed part 32*a* of the bottom wall 32 and the rear wall 35 of the cavity 21.

The burner assembly 23 may further include a nozzle holder 220 for spraying gas into the burner 110.

The nozzle holder 220 may be disposed between the rear wall 35 of the cavity 21 and the outer case 11. For example, the nozzle holder 220 may be fixed to the rear wall 35 of the cavity 21. In another example, if an insulator is disposed on the outside of the cavity 21, the nozzle holder 220 may be disposed on the insulator.

The nozzle holder 220 may be aligned with the burner 110 passing through the rear wall 35 of the cavity 21 to spray gas into the burner 110.

The burner assembly 23 may further include a burner reflector 200. The burner reflector 200 may have an opening 202 through which the fan 210 passes. The burner reflector 200 may be coupled to the rear wall 35 of the cavity 21 within the cooking chamber 22. Here, the burner reflector 200 may be disposed between the burner cover 130 and the rear wall 35 of the cavity 21. The burner reflector 200 may be configured to reflect heat of the burner 110 to the cooking chamber 22.

Figure 5:
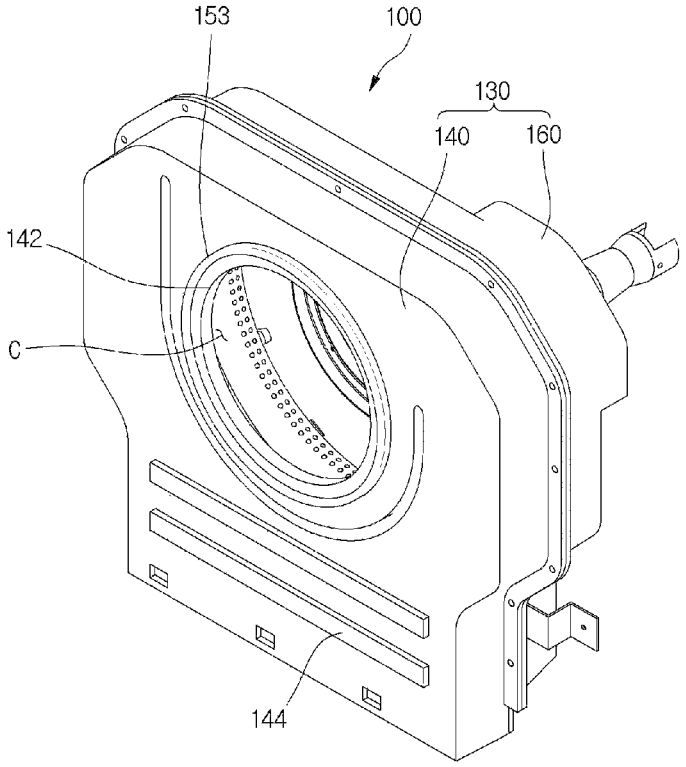
FIG. 5 is a perspective view of a burner device according to the first embodiment.
Figure 6:
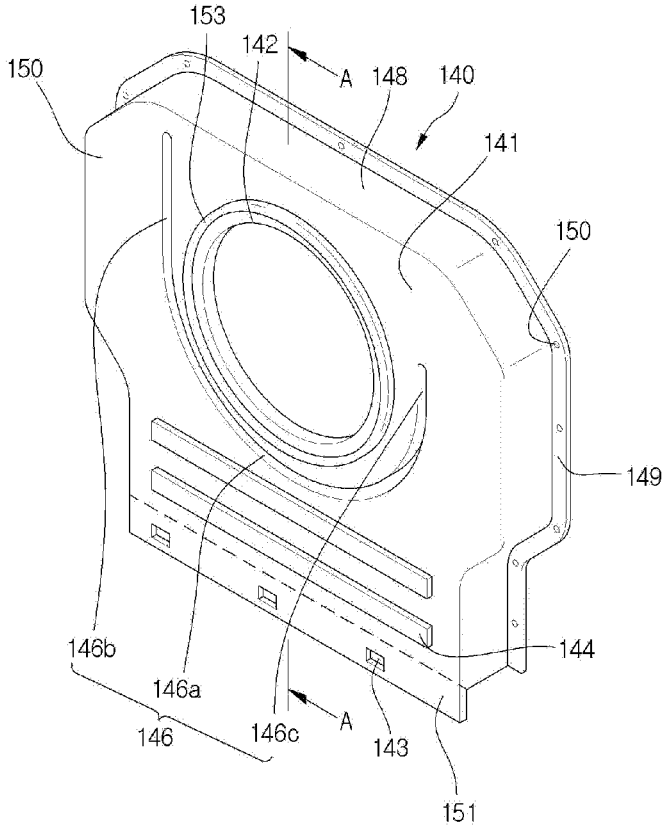
FIG. 6 is a perspective view illustrating a first cover of the burner device of FIG. 5.
Figure 7:
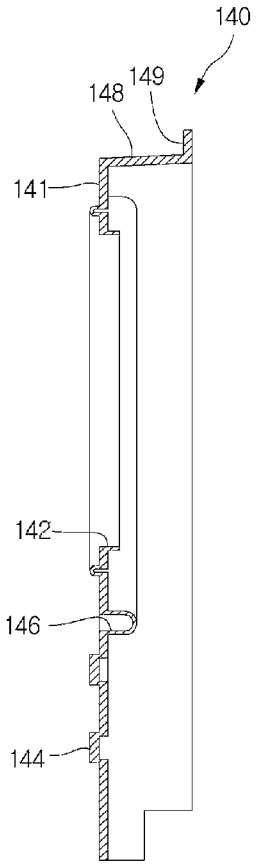
FIG. 7 is a cross-sectional view taken along line A-A' of FIG. 6.

FIG. 5 is a perspective view of a burner device according to the first embodiment, FIG. 6 is a perspective view illustrating a first cover of the burner device of FIG. 5, and FIG. 7 is a cross-sectional view taken along line A-A' of FIG. 6.

Referring to FIGS. 4 to 7, the burner cover 130 includes a combustion chamber C in which gas is burned within the second chamber (see reference numeral 22*b* of FIG. 14). Also, the burner 110 is disposed in the combustion chamber C. That is, the burner cover 130 partitions the second chamber (see reference numeral 22*b* of FIG. 14) into the combustion chamber C and an exhaust passage (see reference symbol P1 of FIG. 14) in which the fan 210 is disposed.

As shown in FIG. 5, the burner cover 130 includes a first cover 140 and a second cover 160.

Referring to FIG. 6, the first cover 140 may include a first plate 141, a first extension part 148 extending backward from the first plate 141, and a first coupling part 149 bent from the first extension part 148.

A first opening 142 through which air within the cooking chamber 22 passes, which is suctioned through the air suction hole 192 of the partition plate 190, is defined on the first plate 141.

The air suction hole 192 of the partition plate 190 may have a grill shape (see FIG. 4). That is, the air suction hole 192 may be defined as a plurality of holes. However, the air suction hole 192 that is defined as the plurality of holes may have a circular shape on the whole profile.

Here, the first opening 142 may have a diameter equal to or greater than that of the profile of the air suction hole 192 so that the air passing through the air suction hole 192 smoothly passes through the first opening 142 of the first cover 140.

At least one first reinforcing part 144 for reinforcing strength of the first plate 141 may be disposed under the first opening 142 on the first plate 141. The at least one first reinforcing part 144 may be disposed lengthwise in a horizontal direction. Although a plurality of first reinforcing parts 144 are vertically spaced apart from each other in FIG. 6, the current embodiment is not limited to the number and position of the first reinforcing part 144 shown. For example, the at least one first reinforcing part 141 may extend vertically lengthwise, and a plurality of first reinforcing parts 144 may be horizontally spaced apart from each other.

The first reinforcing part 144 may protrude forward from the first plate 141. That is, a portion of the first plate 141 may be formed so that the first reinforcing part 144 protrudes from the first plate 141 toward the door 25.

In the state where the partition plate 190 is disposed on the rear wall 35 of the cavity 21, the first reinforcing part 144 may contact the partition plate 190. Alternatively, in the state where the partition plate 190 is disposed on the rear wall 35 of the cavity 21, the first reinforcing part 144 may be spaced apart from the partition plate 190. In addition, when an external force is applied to the partition plate 190, or the first plate 141 is expanded by heat, the first reinforcing part 144 may contact the partition plate 190.

According to the current embodiment, the thermal deformation of the first plate 141 may be minimized by the first reinforcing part 144. Also, even though the first plate 141 is deformed, the first reinforcing part 144 may contact the partition plate 190 to prevent the first plate 141 from being additionally deformed.

In another example, a portion of the plurality of first reinforcing part 144 may protrude forward from the first plate 141 toward the door 25, and the another portion may protrude backward from the first plate 141. Alternatively, at least one first reinforcing part 144 may protrude backward from the first plate 141 toward the rear wall 35 of the cavity 21.

A second reinforcing part 153 for reinforcing strength may be disposed on a circumferential part of the first opening 142 on the first plate 141. For example, the first opening 142 may have a circular shape, and the second reinforcing part 153 may have a circular ring shape that surrounds the first opening 142. However, the current embodiment is not limited to the shape and number of the first opening 142 and the shape and number of the second reinforcing part 153.

The second reinforcing part 153 may protrude forward from the first plate 141. That is, a portion of the first plate 141 may be formed so that the second reinforcing part 153 protrudes from the first plate 141 toward the door 25.

In the state where the partition plate 190 is disposed on the rear wall 35 of the cavity 21, the second reinforcing part 153 may contact the partition plate 190. In another example, in the state where the partition plate 190 is disposed on the rear wall 35 of the cavity 21, the second reinforcing part 153 may be spaced apart from the partition plate 190. In addition, when an external force is applied to the partition plate 190, or the first plate 141 is expanded by heat, the second reinforcing part 153 may contact the partition plate 190.

The first opening 142 of the first plate 141 may be disposed to face the air suction hole 192 of the partition plate 190. Thus, since air passing through the air suction hole 192 of the partition plate 190 flows into the first opening 142 of the first plate 141 without being interfered in flow direction, the air may be smoothly circulated within the cooking chamber 22.

The first plate 141 may include a first insertion part 151 having at least one first inflow hole 143 through which air is introduced into the combustion chamber C. For example, the at least one first inflow hole 143 may be defined under the first reinforcing part 144 in the first plate 141.

Although a plurality of first inflow holes 143 are horizontally spaced apart from each other in FIG. 6, the current embodiment is not limited to the number, position, and shape of the first inflow hole 143.

The first insertion part 151 of the first cover 140 may pass through the bottom wall 23 of the cavity 21. Thus, the at least one first inflow hole 143 may be defined outside the cavity 21.

Also, air outside the cavity 21 may be supplied into the combustion chamber C through the at least one first inflow hole 143.

An air guide 146 for guiding the air supplied into the combustion chamber C to the flame generated at the burner 110 and to increase a contact time between the air and the flame may be disposed on the first plate 141.

The air guide 146 may protrude backward from the first plate 141. That is, a portion of the first plate 141 may be formed so that the air guide 146 protrudes from the first plate 141 toward the rear wall 35 of the cavity 21.

The air guide 146 may include linear parts 146*b* and 146*c* defined on one end or both ends of a curved part 146*a*. Alternatively, the air guide 146 may include only the curved part 146*a*.

For example, the curved part 146*a* of the air guide 146 may have an arc shape. The curved part 146*a* may have a radius greater than that of the second reinforcing part 153.

Thus, a portion of the curved part 146*a* may be disposed between the second reinforcing part 153 and the first reinforcing part 144. The curved part 146*a* may have curvature radius that is equal to or less than that of an inner periphery surface of the burner 110. Thus, the air introduced into the combustion chamber C may be guided to the flame of the burner 110 by the air guide 146.

The air guide 146 may be integrated with the first plate 141 or coupled to the first plate 141.

Also, the air guide 146 may have a curved shape in at least a section to smoothly guide the air flow.

At least one first coupling hole 150 that is coupled to the second cover 160 by a coupling member may be defined on the first coupling part 149.

Figure 8:
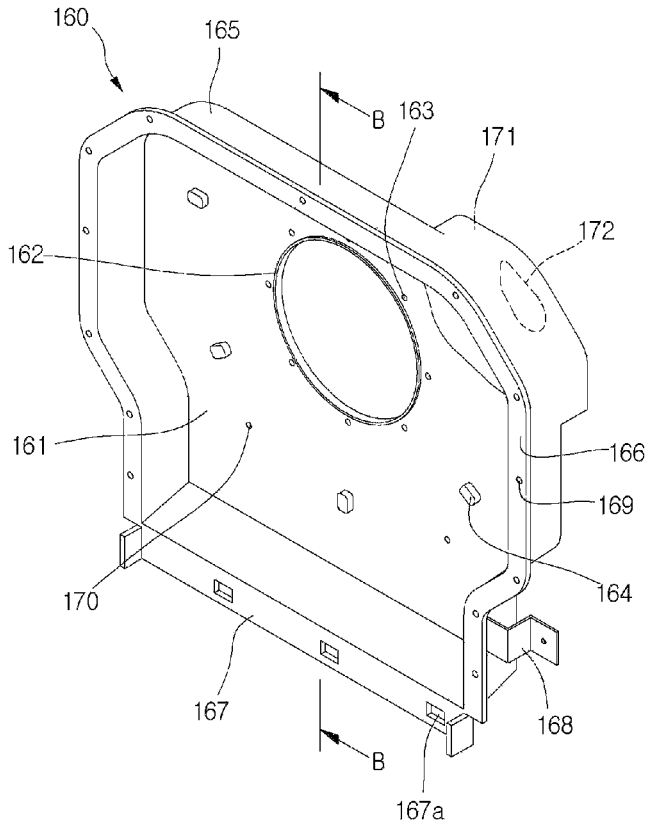
FIG. 8 is a perspective view illustrating a second cover of the burner device of FIG. 5.
Figure 9:
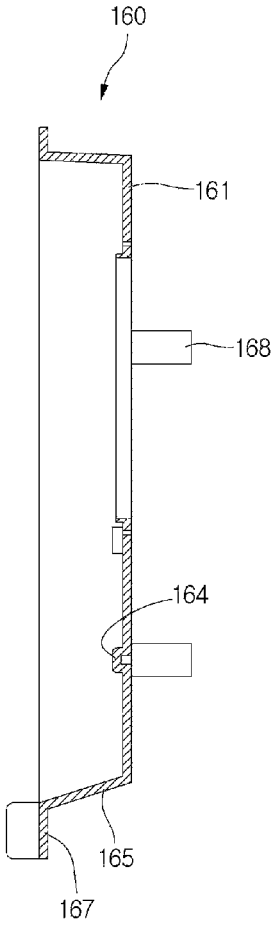
FIG. 9 is a cross-sectional view taken along line B-B' of FIG. 8.

FIG. 8 is a perspective view illustrating a second cover of the burner device of FIG. 5, and FIG. 9 is a cross-sectional view taken along line B-B' of FIG. 8.

Referring to FIGS. 4, 5, 8, and 9, the second cover 160 may include a second plate 161, a second extension part 165 extending forward from the second plate 161, and a second coupling part 166 bent from the second extension part 165.

A second opening 162 through which air heated in the combustion chamber C is discharged may be defined on the second plate 161. The second opening 162 may have a circular shape, but is not limited thereto. The second opening 162 may have a diameter less than that of the first opening 142.

A burner coupling hole 170 to which the burner 110 is coupled may be defined on the second plate 161. Also, at least one protrusion 164 for preventing the burner 110 from directly contacting the second plate 161 may be disposed on the second plate 161.

The at least one protrusion 164 may protrude toward the burner 110 in the state where the burner 110 is disposed on the second plate 161. That is, a portion of the second plate 161 may be formed so that the at least one protrusion 164 protrudes towards the burner 110.

For example, the at least one protrusion 164 may contact the burner 110. In another example, the at least one protrusion 164 may be adjacent to the burner 110 in a state where the protrusion 164 is spaced apart from the burner 110. Also, when an external force is applied to the burner 110, or the second plate 161 is expanded by heat, the at least one protrusion 164 may contact the burner 110. Thus, in either event, the at least one protrusion 164 may prevent the burner 110 from directly contacting the second plate 161.

Also, in case of the current embodiment, the at least one protrusion 164 may be disposed on the second plate 161 to minimize thermal deformation of the second plate 161.

In the state where the burner 110 is disposed on the second cover 160, and the first cover 140 is coupled to the second cover 160, the burner 110 may be spaced apart from the first plate 141 of the first cover 140 and the second plate 161 of the second cover 160. Thus, air outside the cavity 21, which is introduced into the combustion chamber C may flow between the first plate 141 and the burner 110 and between the second plate 161 and the burner 110.

When the plurality of protrusions 164 are disposed on the second plate 161, the plurality of protrusions 164 may be disposed to overlap the burner 110 in forward and backward directions when the burner 110 is disposed on the second cover 161.

At least one stabilizer coupling hole 163 to which the stabilizer 180 is coupled may be further defined on the second plate 161.

At least one second coupling hole 169 to which the coupling member passing through the first coupling hole 150 of the first coupling part 149 is coupled may be defined on the second coupling part 169.

In another example, the first and second coupling parts may not be disposed on the first and second covers, respectively. Also, the first extension part 148 of the first cover 140 and the second extension part 165 of the second cover 160 may be coupled to each other by a coupling member.

The second cover 160 may further include a second insertion part 167 passing through the bottom wall 32 of the cavity 21. At least one second inflow hole 167*a* may be defined on the second insertion part 167. Thus, the at least one second inflow hole 167*a* may be disposed outside the cavity 21.

Also, air outside the cavity 21 may be supplied into the combustion chamber C through the at least one second inflow hole 167*a*.

In the state where the first cover 140 is coupled to the second cover 160, the first insertion part 151 of the first cover 140 may be spaced apart from the second insertion part 167 of the second cover 160.

Although a plurality of second inflow holes 167*a* are horizontally spaced apart from each other in FIG. 8, the current embodiment is not limited to the number, position, and shape of the second inflow hole 167*a*.

According to the current embodiment, the air outside the cavity 21 may smoothly flow into the combustion chamber C by the at least one first inflow hole 143 defined on the first cover 140 and the at least one second inflow hole 167*a* defined on the second cover 160.

The second cover 160 may further include at least one installation part 168 for installing the second cover 160 on the rear wall 35 of the cavity 21.

The installation part 168 may be disposed on the second plate 161, but is not limited thereto. Thus, the second plate 161 may be spaced apart from the rear wall 35 of the cavity in the state where the second cover 160 is disposed on the rear wall 35 of the cavity 21 due to the installation of the installation part 168. Also, the fan 210 may be disposed in a space between the second plate 161 and the rear wall 35 of the cavity 21. That is, the fan 210 may be disposed in a separate space outside the combustion chamber C on which the burner cover 130 is disposed.

The second cover 160 may further include a burner through-part 171 through which a portion of the burner 110 passes. The burner through-part 171 may protrude backward from the second plate 161 toward the rear wall 35 of the cavity 21, but is not limited thereto. That is, the second plate 161 may be deformed so that the burner through-part 171 protrudes backward from the second plate 161.

Also, a burner through-hole 171 may be defined on the burner through-part 171. The burner through-hole 172 may be aligned with the burner hole 36 defined on the rear wall 35 of the cavity 21.

In the state where the second cover 160 is disposed on the rear wall 35 of the cavity 21, the burner through-part 171 may contact the rear wall 35 of the cavity 21.

The heated air passing through the second opening 162 of the burner cover 130 may flow into a space between the second cover 160 and the rear wall 35 of the cavity 21 and then be discharged into the cooking chamber 22 through the discharge hole 194 of the partition plate 190.

Here, in the state where the second cover 160 is disposed on the rear wall 35 of the cavity 21, the burner through-part 171 may contact the rear wall 35 of the cavity 21 to prevent the heated air from being reintroduced into the combustion chamber C through the burner through-hole 172.

In addition, it may prevent the heated air from being discharged to the outside of the cavity 21 through the burner hole 36 of the rear wall 35 of the cavity 21.

Figure 10:
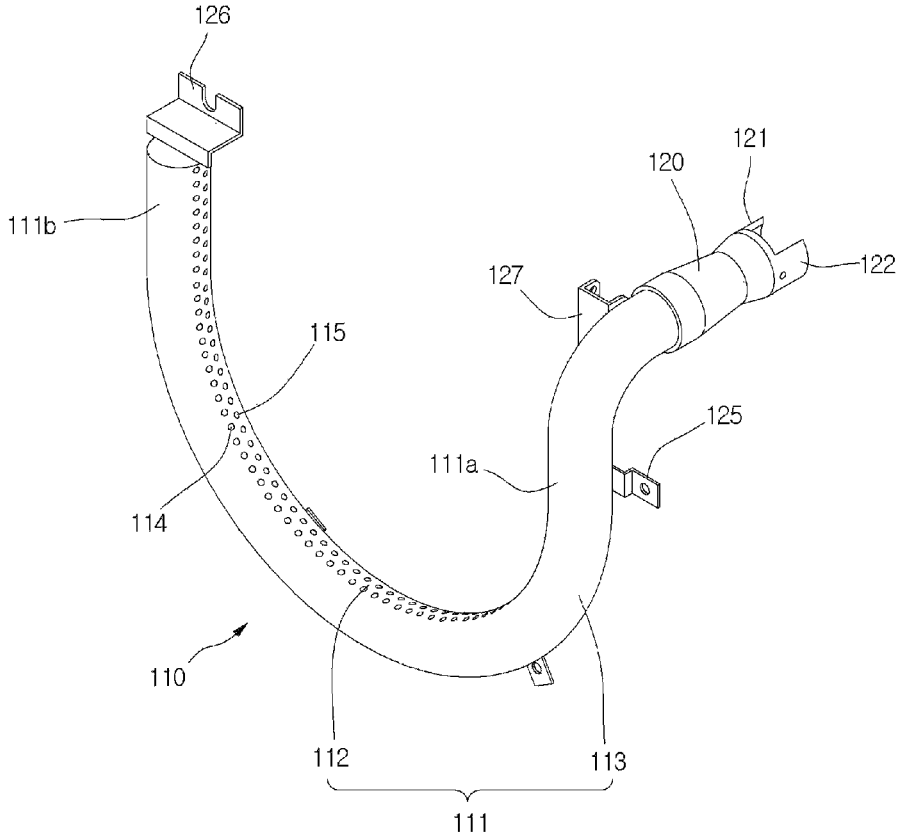
FIGS. 10 and 11 are perspective views of a burner according to the first embodiment.
Figure 11:
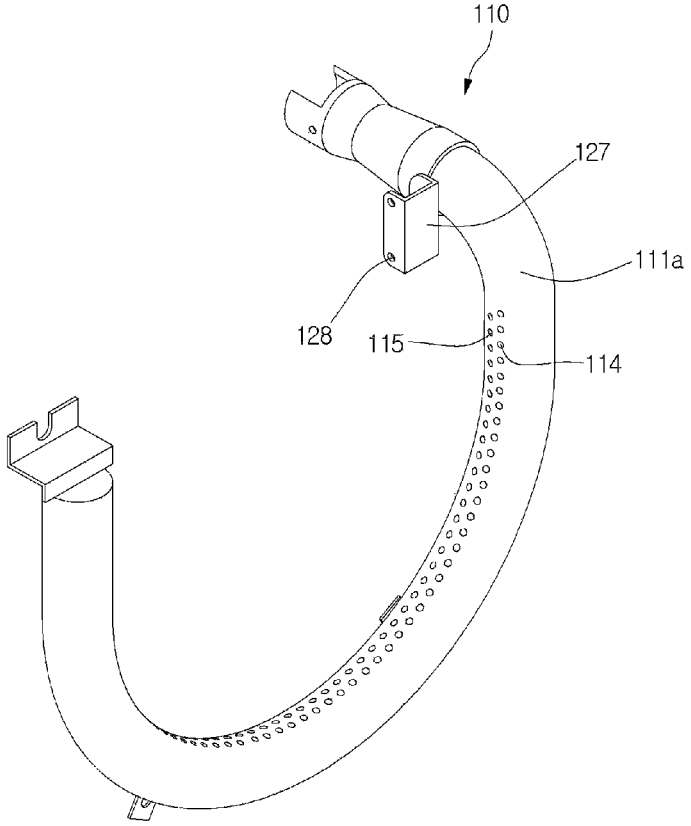

FIGS. 10 and 11 are perspective views of the burner according to the first embodiment.

Referring to FIGS. 10 and 11, the burner 110 according to the first embodiment includes a burner tube 111 having both ends spaced apart from each other. That is, in the current embodiment, the burner tube 111 may have a non-annular shape.

The burner tube 111 may have a "U" shape, but is not limited thereto. A supply part 120 for receiving gas and air may be disposed on a first end 111*a* of the burner tube 111, and a second end 111*b* of the burner tube 111 may be blocked.

The supply part 120 may inclinedly extend from the first end 111*a* of the burner tube 111. The gas and air supplied through the supply part 120 changes in flow direction from the first end 111*a* toward the second end 111*b* along the burner tube 111.

That is, in the current embodiment, the gas and air supplied through the supply part 120 may flow only in one direction within the burner tube 111.

The burner tube 111 may be formed in a curved shape on the whole, or at least one of the first and second ends 111*a* and 111*b* may be formed a straight-line shape, and the other section may be formed in a curved shape.

The burner tube 111 may include an inner periphery 112 and an outer periphery 113.

In the current embodiment, since the tube 111 has a "U" shape, the inner periphery 112 or the outer periphery 113 may have a plurality of curvatures different from each other. That is, the curvature of the inner or outer peripheries 112 and 113 of the burner tube 111 may vary in a longitudinal direction of the burner tube 111.

A plurality of gas outlet holes 114 and 115 are defined on the inner periphery 112 of the burner tube 111. The plurality of gas outlet holes 114 and 115 are disposed in a plurality of rows. In the current embodiment, the "row" may represent a set of gas outlet holes that are arranged in a direction corresponding to the extension direction of the burner tube 111.

The gas outlet holes 114 and 115 arranged in the plurality of rows may include a plurality of first gas outlet holes 114 and a plurality of second gas outlet holes 115.

Although the gas outlet holes 114 and 115 arranged in two rows are defined on the inner periphery 112 of the burner tube 111 in FIG. 10, the current embodiment is not limited to the number of rows of the gas outlet holes. That is, the gas outlet holes arranged in a single row may be defined on the inner periphery 112 of the burner tube 111.

The gas outlet holes 114 and 115 arranged in a row may be spaced apart from each other in the longitudinal direction of the burner tube 111. Also, the gas outlet holes 114 arranged in one row may be spaced apart from the gas outlet holes 115 arranged in the other row.

Although not limited thereto, the gas outlet holes 114 and 115 adjacent to each other may be disposed in a zigzag form so that flames generated in the gas outlet holes 114 and 115 that are adjacent to each other and arranged in two rows do not interfere with each other.

That is, the gas outlet holes 115 arranged in the other row may be disposed in a region corresponding to that between the gas outlet holes 114 adjacent to each other and arranged in one row.

The inner periphery 112 of the burner tube 111 may have a minimum curvature radius greater than a maximum curvature radius of the curved part 146*a* of the air guide 146 of the first cover 140.

Also, the inner periphery 112 of the burner tube 111 may have a minimum curvature radius greater than a radius of the second opening 162 of the second cover 160. When the second opening 162 has the non-annular shape, the inner periphery 112 of the burner tube 111 may have a minimum curvature radius greater than a maximum radius of the second opening 162.

A plurality of brackets 125 and 126 for installing the burner tube 111 on the second cover 160 may be disposed on the burner tube 111. One bracket 126 of the plurality of brackets 125 and 126 may be disposed on the second end 111*b* of the burner tube 110.

Although the plurality of brackets 125 and 126 are coupled to the second cover 160 by using a screw, the current embodiment is not limited to the coupling method between the plurality of brackets 125 and 126 and the second cover 160.

In the state where the plurality of brackets 125 and 126 are coupled to the second cover 160, the burner tube 111 may be spaced apart from the second plate 161 of the second cover 160.

The burner tube 111 may further include an igniter support 127 for installing the igniter 189. For example, the igniter support 127 may be disposed at a position adjacent to the supply part 120 in the burner tube 110. The igniter support 127 may have a coupling hole 128 to which the coupling member for coupling with the igniter 127 is coupled.

The supply part 120 may include a plurality of first guides 121 and 122 for aligning the supply part 120 with the nozzle holder 220. The plurality of first guides 121 and 122 may be spaced apart from each other, and air outside the cavity 21 may be introduced into the supply part 120 together with the gas sprayed from the nozzle holder 220 through the space between the plurality of first guides 121 and 122.

The supply part 120 may pass through the burner through-hole 172 of the second cover 160 and the burner hole 36 of the rear wall 35 of the cavity 21.

Figure 12:
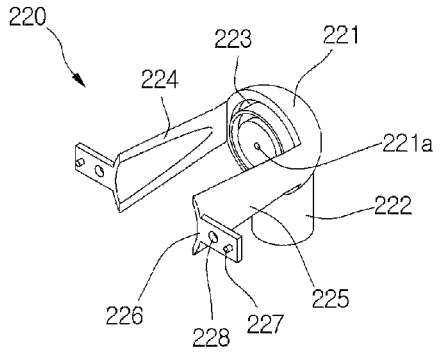
FIG. 12 is a perspective view of a nozzle holder according to the first embodiment.
Figure 13:
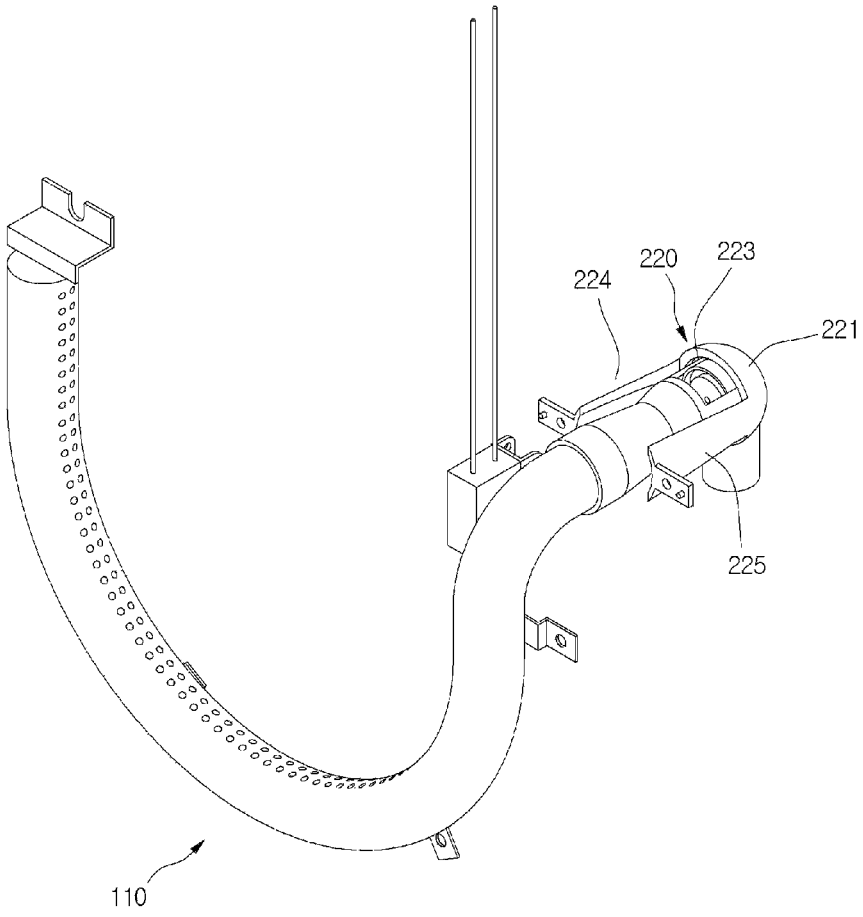
FIG. 13 is a view of a state in which a supply part of a burner is aligned with the nozzle holder of FIG. 12.

FIG. 12 is a perspective view of a nozzle holder according to the first embodiment, and FIG. 13 is a view of a state in which a supply part of a burner is aligned with the nozzle holder of FIG. 12.

Referring to FIGS. 12 and 13, the nozzle holder 220 may include a holder body 221 for spraying gas, a gas inflow part 222 disposed on one side of the holder body 221, and a plurality of second guides 224 and 225 for guiding alignment between the supply part 120 of the burner 110 and the holder body 221.

A gas spraying hole 221*a* is defined on the holder body 221.

The plurality of second guides 224 and 225 may be spaced apart from each other and have a distance that gradually decreases therebetween from an outer end thereof toward the holder body 221. That is, a distance between the plurality of second guides 224 and 225 at a portion that is adjacent to the gas spraying hole 221*a* is less than that between outer ends of the plurality of second guides 224 and 225.

Also, the distance between the outer ends of the plurality of second guides 224 and 225 is greater than that between outer ends of the plurality of first guides 121 and 122 of the supply part 120 of the burner 110.

As described above, since the distance between the plurality of second guides 224 and 225 gradually decreases toward the holder body 221, the first guides 121 and 122 of the supply part 120 may be easily disposed between the plurality of second guides 224 and 225.

An accommodation groove 223 for accommodating the ends of the plurality of first guides 121 and 122 may be defined on the holder body 221. In the state where the ends of the plurality of first guides 121 and 122 are accommodated in the accommodation groove 223, a portion of the plurality of first guides 121 and 122 may contact the plurality of second guides 224 and 225.

In another example, the holder body 221 may include a protrusion, and a gas spraying hole 221*a* may be defined on the protrusion. Also, the plurality of first guides 121 and 122 may be disposed to surround a portion of the protrusion. That is, the protrusion may be disposed between the plurality of first guides 121 and 122.

A coupling part 226 to be coupled to the rear wall 35 of the cavity 21 may be disposed on each of the plurality of second guides 121 and 122. The coupling part 226 may be bent from the outer end of each of the plurality of second guides 224 and 225. The coupling part 226 may include a guide protrusion 227 for guiding to a coupling position and a coupling groove 228 to which a coupling member (not shown) is coupled.

That is, according to the current embodiment, the nozzle holder 220 may be coupled to the rear wall 35 of the cavity 21, and the burner 110 may be coupled to the second cover 160. Thus, the user may take the burner 110 out of the cooking chamber 22 to service the burner 110 without removing the nozzle holder 220.

Also, even though the nozzle holder 220 and the burner 110 are not coupled to each other, the plurality of first guides 121 and 122 of the supply part 120 may be accommodated into the accommodation groove 223 of the nozzle holder 220 in the state where the plurality of first guides 121 and 122 are disposed between the plurality of second guides 224 and 225 of the nozzle holder 220. Thus, the supply part 120 of the burner 110 and the gas spraying hole 221*a* of the holder body 221 may be aligned with each other.

In the state where the supply part 120 of the burner 110 and the gas spraying hole 221*a* of the holder body 221 are aligned with each other, a space may be defined between the plurality of second guides 224 and 225. Thus, while gas is sprayed from the gas spraying hole 221*a* to the supply part 120 of the burner 110, the air surrounding the supply part 120 and the nozzle holder 220 may be introduced into the supply part 120.

Although the plurality of first guides are disposed on the supply part, and the plurality of second guides are disposed on the nozzle holder in the foregoing embodiment, the present disclosure is not limited thereto. For example, one first guide may be disposed on the supply part, and one second guide may be disposed on the nozzle holder.

In another example, the nozzle holder 220 may be disposed on the rear wall 35 of the cavity 21 within the cooking chamber 22, and the burner 110 may be disposed on the burner cover 130. However, in this case, a portion of the nozzle holder 220, i.e., a portion of the nozzle holder in which the gas outlet hole is defined may be disposed outside the cavity 21. This is done because air outside the cavity 21 has to be supplied into the supply part 120 while the gas is sprayed into the supply part 120.

In this case, the burner 110 may be taken out of the cooking chamber 22 without removing the nozzle holder 220. Also, when the burner 110 is assembled, the supply part 120 and the gas spraying hole 221*a* of the nozzle holder 220 may be aligned with each other.

FIG. 14 is a vertical cross-sectional view of a state in which the burner assembly is installed in the cavity according to the first embodiment.

Referring to FIG. 14, a through-hole 32*c* through which the insertion parts 151 and 167 of the burner cover 130 pass may be defined on the bottom wall 32 of the cavity 21. Thus, since the insertion parts 151 and 167 of the burner cover 130 pass through the through hole 32*c*, the insertion parts 151 and 167 may be disposed outside the cavity 21.

The first insertion part 151 of the first cover 140 and the second insertion part 167 of the second cover 160 may be spaced apart from each other to form a third inflow hole 167*b*.

Also, the fan 210 is disposed in the exhaust passage P1 that is an external to the combustion chamber C. The exhaust passage P1 (or that may be called "exhaust chamber") may be defined by an outer surface of the burner cover 130, the rear wall 35 (or the burner reflector) of the cavity 21, and the partition plate 190.

Thus, according to the current embodiment, the plurality of gas outlet holes 114 and 115 may be defined on the inner periphery of the burner 110, and the fan 210 may be disposed in the combustion chamber C and the independent exhaust passage P1 to prevent the fan 210 from being heated by the flame of the burner 110. Also, after the flame of the burner 110 contacts the air to heat the air, the air may flow into the fan 210. Thus, the air may be sufficiently heated by the heat of the flame.

Also, since the air is heated by the flame generated in the inner periphery of the burner in the combustion chamber C to flow into the fan, even though the flame is curved toward the fan by the air flow due to the rotation of the fan, the air may be heated by the flame.

Hereinafter, an operation of the burner assembly will be described.

When an operation of the burner assembly 100 starts, gas is sprayed from the nozzle holder 220 into the supply part 120 of the burner 110. Then, air A1 (air outside the cavity) around the supply part 120 together with the gas may be supplied into the supply part 120. Here, the air A1 around the supply part 120 may be naturally supplied into the supply part 120 by a pressure difference because a low pressure is formed around the gas supplied into the supply part 120 (natural air-supply method). Thus, when the air is supplied into the supply part 210 by using the natural air-supply method, air that is required for burning gas may not be sufficiently supplied into the supply part 120. In this case, the mixture gas in which the gas and air are mixed may be incompletely burned, and thus an amount of generated carbon dioxide may increase by the incomplete combustion.

However, according to the current embodiment, the insertion parts 151 and 167 of the burner cover 130 may pass through the bottom wall 32 of the cavity 21 and be disposed outside the cavity 21. Also, since the plurality of inflow holes 143, 167*a*, and 167*b* are defined outside the cavity 21, additional air for burning the mixture gas of the burner 110 may be introduced into the combustion chamber C.

The additional air A2 introduced into the combustion chamber C may flow into the burner 110. As described above, since the burner 110 is spaced apart from the first plate 141 of the first cover 140 and the second plate 161 of the second cover 160, the air within the combustion chamber C may flow into the space between the burner 110 and the first plate 141 and the space between the burner 110 and the second plate 161.

Thus, the air within the combustion chamber C may smoothly flow to the first and second gas outlet holes 114 and 115, which are defined on the burner 110.

Also, since the air guide 146 is disposed on the first cover 140, the additional air A2 may be guided to the first gas outlet hole 114 by the air guide 146. Thus, the additional gas A2 may be sufficiently supplied into the first gas outlet hole 114.

In the state where the mixture gas is supplied into the burner 110, the mixture gas may be ignited by the igniter 189 to generate flame in the burner 110. Also, the fan motor 212 may be turned on to rotate the fan 210.

When the fan 210 rotates, the air within the first chamber 22*a* may be introduced into the combustion chamber C within the second chamber 22*b* through the air suction hole 192 of the partition plate 190. Here, the air introduced into the combustion chamber C may pass through the region in which the inner periphery of the burner is defined.

The air introduced into the combustion chamber C may be heated by the flame generated in the burner 240, and then be discharged from the combustion chamber C through the opening 184 of the stabilizer 180.

The air discharged from the combustion chamber C may flow into the exhaust passage P1 defined between the second cover 160 and the rear wall 35 of the cavity 21 and then be disposed into the first chamber 22*a* through the discharge hole 194 of the partition plate 190. Referring to FIG. 4, the heated air discharged through the discharge holes 194 located at the extension part 193 and/or the front plate 191 provides for a better dispersement of heated air in the cooking chamber 22. In the conventional cooking appliance, the conventional burner is located at the bottom of the cooking chamber 22 and at the recessed part 32*a*. Thus, the heated air is hotter at the bottom than at the top. In contrast, the burner assembly of the present embodiment located at the rear wall 35 of the cavity 21 and discharging heated air through discharge holes 194 provides for a better dispersement of heated air in the cooking chamber 22 to cook foods.

According to the current embodiment, the burner cover 130 may define the independent combustion chamber C, and the combustion chamber C and the exhaust passage P1 may be partitioned by the burner cover 130.

Thus, it may prevent the air flowing into the exhaust passage P1 from being reintroduced into the combustion chamber C.

Although the burner assembly is disposed on the rear wall of the cavity within the cavity in the foregoing embodiment, the present disclosure is not limited thereto. For example, the burner assembly may be disposed on the rear wall of the cavity that is outside of the cavity.

Alternatively, the burner assembly may be disposed on one sidewall of both sidewalls of the cavity.

Hereinafter, a method of assembling the burner assembly will be described.

First, the burner reflector 200 may be coupled to the rear wall 35 of the cavity 21 inside the cooking chamber 22.

Also, the nozzle holder 220 may be coupled to the rear wall 35 outside the cavity 20 regardless of whether the burner reflector 200 is coupled.

Then, in the state where the fan 210 is disposed at a front side of the rear wall 35 of the cavity 21, the fan 210 may be coupled to the fan motor 212.

Also, in the state where the stabilizer 180 is disposed on the second cover 160, the second cover 160 may be coupled to the rear wall 35 of the cavity inside the cooking chamber 22. Then, the burner 110 is disposed on the second cover 160. Also, the first cover 140 is coupled to the second cover 160.

Finally, the partition plate 190 is coupled to the rear wall 35 of the cavity 21 within the cooking chamber 22.

Although the burner cover 130 is constituted by two parts to define the combustion chamber C in the foregoing embodiment, the present disclosure is not limited thereto. For example, one cover or at least three covers may define the combustion chamber C. That is, if the combustion chamber C and the exhaust passage P1 are partitioned, the present disclosure is not limited to the shape of the burner cover 130 and the number of covers constituting the burner cover.

Also, although the fan is disposed at a rear side of the burner cover 130, and the air heated by the burner flows into the fan in the foregoing embodiment, the present disclosure is not limited thereto. For example, the fan may be disposed at a front side of the burner cover 130, and the burner may heat the air passing through the fan. However, in case of the former, the fan may be a fan by which air flowing in an axis direction is switched into air flowing in a radius direction to radially discharge the air. In case of the latter, the fan may be a fan for axially discharging air flowing in an axis direction.

Although the burner cover 130 is constituted by two parts to define the combustion chamber C in the foregoing embodiment, the present disclosure is not limited thereto. For example, one cover or at least three covers may define the combustion chamber C. That is, if the combustion chamber C and the exhaust passage P1 are partitioned, the present disclosure is not limited to the shape of the burner cover 130 and the number of covers constituting the burner cover.

Figure 15:
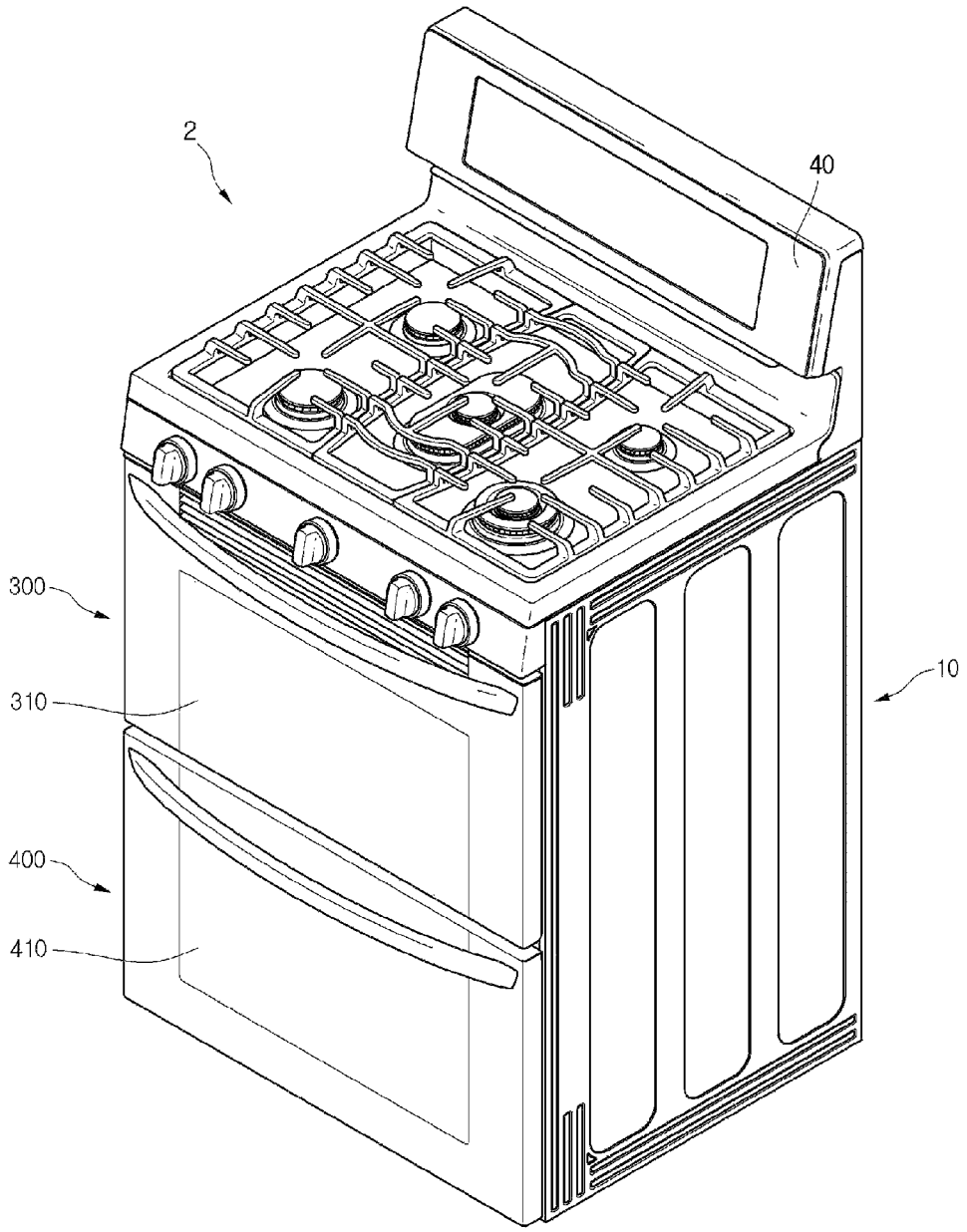
FIG. 15 is a perspective view of a cooking appliance according to a second embodiment.
Figure 16:
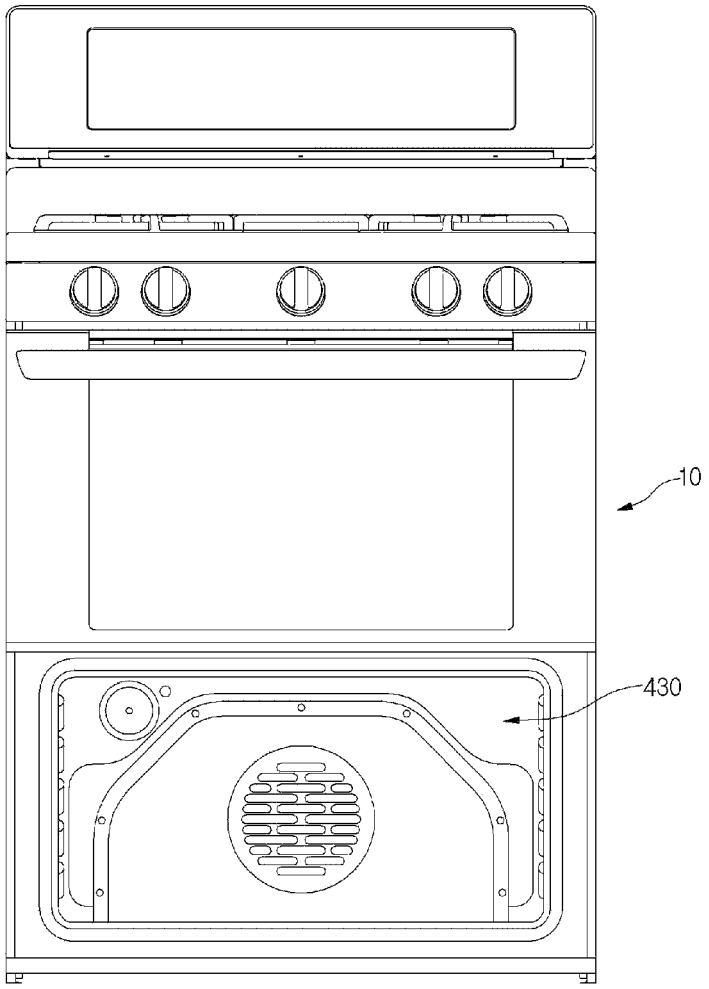
FIG. 16 is a front view of the cooking appliance in which a second door is separated in FIG. 15.

FIG. 15 is a perspective view of a cooking appliance according to a second embodiment, and FIG. 16 is a front view of the cooking appliance in which a second door is separated in FIG. 15.

The current embodiment is the same as the forgoing embodiment except for the number of oven unit. Thus, a characterizing part according to the current embodiment will be principally described.

Referring to FIGS. 15 and 16, a cooking appliance 2 according to a second embodiment may include a plurality of oven units 300 and 400.

The plurality of oven units 300 and 400 may include a first oven unit 300 and a second oven unit 400 disposed under the first oven unit 300. The plurality of oven units 300 and 400 may include doors 310 and 410, respectively.

A burner assembly 430 may be disposed on at least one of the plurality of oven units 300 and 400. Since the burner assembly 430 has the same structure as that of the foregoing embodiment, its detailed description will be omitted.

Although the burner assembly 430 is disposed on the second oven unit 400 in FIG. 16, the burner assembly 430 may be disposed on the first oven unit 300 or on each of the plurality of oven units 300 and 400.

Figure 17:
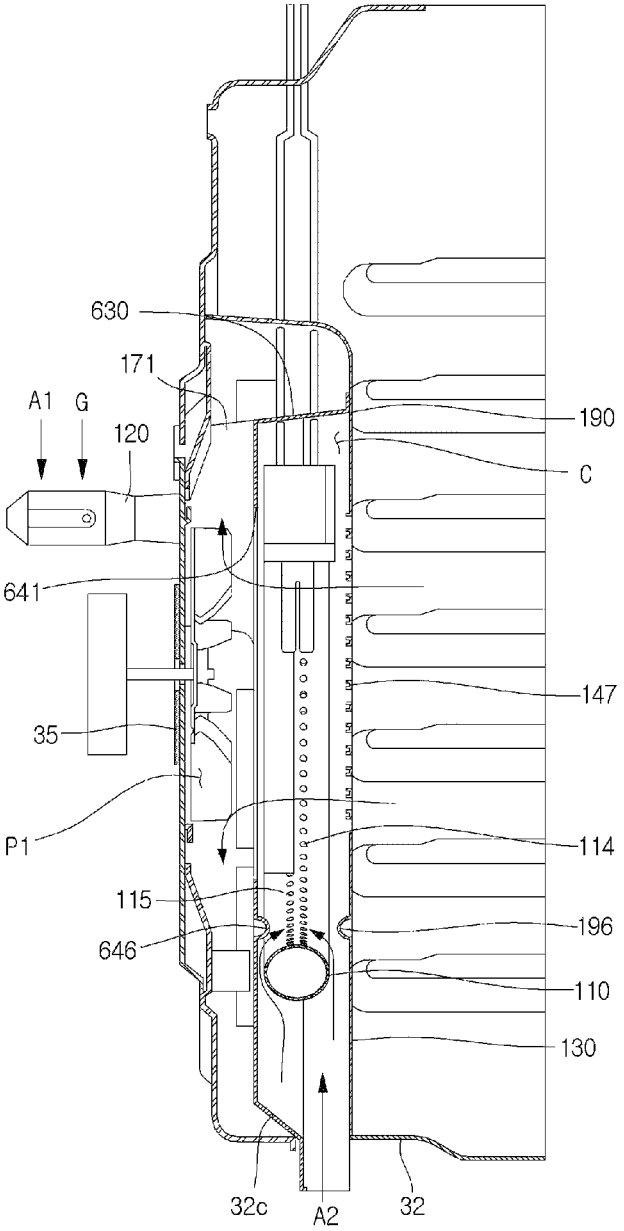
FIG. 17 is a vertical cross-sectional view of a state in which a burner assembly is installed in a cavity according to a third embodiment.

FIG. 17 is a vertical cross-sectional view of a state in which a burner assembly is installed in a cavity according to a third embodiment.

The current embodiment is the same as the first embodiment except for a structure of a burner cover. Thus, a characterizing part according to the current embodiment will be principally described, and other parts will be denoted by the descriptions of the first embodiment.

Referring to FIG. 17, a combustion chamber C according to a third embodiment may be defined by a burner cover 630 and a partition plate 190. That is, in the current embodiment, the burner cover 630 may be provided as a single member, and the single burner cover 630 and the partition plate 190 may define a combustion chamber C in which a burner 110 is disposed.

The burner cover 630 may be disposed on a rear wall 35 of a cavity 21. Also, in a state where the partition plate 190 is disposed on the rear wall 35 of the cavity 21, the partition plate 190 may contact the burner cover 630. That is, a front end of the burner cover 630 may contact a back surface of the partition plate 190.

The partition plate 190 has an air inflow hole 192 for introducing air within a cooking chamber 22 into the combustion chamber C. The burner cover 630 may have an opening 641 through which air heated in the combustion chamber C passes.

Also, the partition plate 190 may include a first air guide 196, and the burner cover 630 may include a second air guide 646. That is, at least one of the partition plate 190 and the burner cover 630 may include the air guide.

Each of the air guides 196 and 646 may be configured to allow additional air introduced into the combustion chamber C to stay around the gas outlet holes 114 and 115 for a time period, thereby improving combustion performance.

According to the current embodiment, the exhaust passage and the combustion chamber may be partitioned by using a simple structure.

Figure 18:
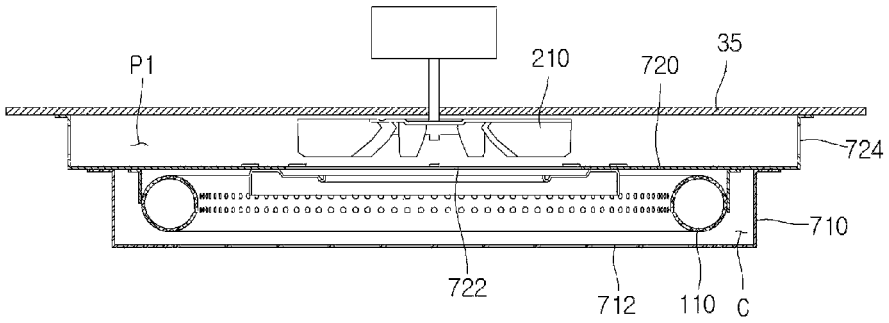
FIG. 18 is a vertical cross-sectional view of a state in which a burner assembly is installed in a cavity according to a fourth embodiment.

FIG. 18 is a vertical cross-sectional view of a state in which a burner assembly is installed in a cavity according to a fourth embodiment.

The current embodiment is the same as the first embodiment expect for structure of a burner cover and partition plate. Thus, a characterizing part according to the current embodiment will be principally described, and other parts will be denoted by the descriptions of the first embodiment.

Referring to FIG. 18, a partition plate 720 according to a fourth embodiment has an exhaust passage P1. The partition plate 720 may be coupled to a rear wall 35 of a cavity 21 to cover a fan 210.

A burner cover 710 may be coupled to a front surface of the partition plate 720, and the partition plate 720 and the burner cover 710 may define a combustion chamber C.

The burner cover 710 has an air inflow hole 712 for introducing air within a cooking chamber 22 into the combustion chamber C. The partition plate 720 may include an opening 722 through which air heated in the combustion chamber C passes and an air discharge hole 724 for discharging air heated in the burner 119 into the cooking chamber 22.

According to the current embodiment, the exhaust passage and the combustion chamber may be partitioned by using a simple structure.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking appliance comprising:

a cavity to provide a cooking chamber;

a door to open and close the cooking chamber;

a partition plate provided in the cavity to partition the cavity into a first chamber and a second chamber, the partition plate facing the door in the closed state, wherein the door closes the first chamber; and a burner assembly disposed in the second chamber to supply heated air into the first chamber, wherein the burner assembly comprises a burner cover to partition the second chamber into a combustion chamber and an exhaust chamber, and a burner disposed in the combustion chamber, wherein the burner cover comprises:

a first cover having a first opening through which air within the first chamber can pass through;

a second cover coupled to the first cover and having a second opening through which air flowing into the combustion chamber can pass through.

2. The cooking appliance according to claim 1, wherein the burner assembly further comprises:

a fan disposed in the exhaust chamber.

3. The cooking appliance according to claim 2, wherein the burner comprises an installation part to install the burner so that the burner is spaced apart from the burner cover.

4. The cooking appliance according to claim 1, wherein the second cover has a burner through-part through which a portion of the burner passes to protrude toward a rear wall of the cavity, and the burner through-part contacts with the rear wall of the cavity.

5. The cooking appliance according to claim 2, wherein the burner cover comprises an inflow hole to introduce air outside the cavity into the combustion chamber.

6. The cooking appliance according to claim 5, wherein the burner cover comprises an insertion part on which the inflow hole is defined, and at least a portion of the insertion part passes through a wall of the cavity and is disposed outside the cavity.

7. The cooking appliance according to claim 5, wherein the burner cover comprises an air guide to guide the air introduced into the combustion chamber through the inflow hole toward a plurality of gas outlet holes defined on the burner.

8. The cooking appliance according to claim 7, wherein the air guide protrudes from a rear side of the burner cover toward the burner within the burner cover.

9. The cooking appliance according to claim 5, wherein the burner cover comprises a first portion having an opening through which air within the first chamber can pass through and a second portion having the inflow hole, at least a portion of the burner disposed in a region within the burner cover between the opening and the inflow hole, and the first portion has a passage-sectional area greater than a passage-sectional area of the second portion.

10. The cooking appliance according to claim 2, wherein the second cover is coupled to a rear wall of the cavity.

11. The cooking appliance according to claim 1, wherein a plurality of gas outlet holes are defined on an inner periphery of the burner, and the inner periphery of the burner has a curvature radius greater than a radius of the first opening.

12. The cooking appliance according to claim 1, wherein the second cover comprises a second plate having the second opening, and a protrusion disposed on the second plate at a position corresponding to the burner to prevent the burner from directly contacting the second plate.

13. The cooking appliance according to claim 1, wherein at least one strength reinforcing part to reinforce strength of the first cover is disposed on the first cover.

14. A cooking appliance comprising:

a cavity to provide a cooking chamber;

a door to open and close the cooking chamber;

a partition plate provided in the cavity to partition the cavity into a first chamber and a second chamber, the partition plate facing the door in the closed state, wherein the door closes the first chamber; and a burner assembly disposed in the second chamber to supply heated air into the first chamber, wherein the burner assembly comprises a burner cover to partition the second chamber into a combustion chamber and an exhaust chamber, a burner disposed in the combustion chamber, and a fan disposed in the exhaust chamber, wherein the fan is disposed at a rear side of the burner cover outside of the combustion chamber.

15. The cooking appliance according to claim 1, wherein the partition plate comprises:

an air suction hole at the partition plate to introduce air within the first chamber into the combustion chamber; and an air discharge hole at the partition plate to discharge air within the exhaust chamber into the first chamber.

16. The cooking appliance according to claim 1, wherein the burner assembly comprises a nozzle holder having a gas spraying hole to spray gas into the burner, the burner comprises a supply part to receive gas and air, wherein the supply part protrudes toward a rear wall of the cavity, and the gas spraying hole of the nozzle holder aligns with the supply part.

17. The cooking appliance according to claim 16, wherein the supply part comprises at least one first guide, and the nozzle holder comprises at least one second guide to guide the at least one first guide of the supply part.

18. The cooking appliance according to claim 17, wherein the nozzle holder has an accommodation groove in which the at least one first guide is accommodated, and the at least one first guide contacts the at least one second guide in the state where the at least one first guide is accommodated into the accommodation groove.

19. The cooking appliance according to claim 17, wherein the supply part comprises a plurality of first guides that are spaced apart from each other, the nozzle holder comprises a plurality of second guides that are spaced apart from each other, and when the plurality of first guides pass through the rear wall of the cavity, the plurality of first guides are disposed between the plurality of second guides.

20. The cooking appliance according to claim 19, wherein a distance between outer ends of the plurality of second guides is greater than a distance between outer ends of the plurality of first guides.

21. The cooking appliance according to claim 20, wherein a distance between the plurality of second guides at a portion adjacent to the gas spraying hole is less than a distance between outer ends of the plurality of second guides.

22. The cooking appliance according to claim 17, wherein at least one second guide is provided with a coupling part to be coupled to the rear wall of the cavity, and a coupling hole is defined on the coupling part.

23. The cooking appliance according to claim 22, wherein a guide protrusion to guide a coupling position is disposed on the coupling part.

24. A cooking appliance comprising:

a cavity to provide a cooking chamber;

a door to open and close the cooking chamber;

a partition plate provided in the cavity to partition the cavity into a first chamber and a second chamber, the partition plate facing the door in the closed state, wherein the door closes the first chamber; and a burner assembly disposed in the second chamber to supply heated air into the first chamber, wherein the burner assembly comprises a burner cover to partition the second chamber into a combustion chamber and an exhaust chamber, a burner disposed in the combustion chamber, and a fan disposed in the exhaust chamber, wherein the burner cover comprises an insertion part on which an inflow hole is defined, and at least a portion of the insertion part passes through a wall of the cavity and is disposed outside the cavity to introduce air outside the cavity into the combustion chamber through the inflow hole.

* * * * *